US008944828B2

(12) United States Patent
Tsao

(10) Patent No.: US 8,944,828 B2
(45) Date of Patent: Feb. 3, 2015

(54) AUDIO JACK CONNECTOR FOR ELECTRONIC DEVICE

(71) Applicant: Chi Mei Communication Systems, Inc., New Taipei (TW)

(72) Inventor: Chang-Wei Tsao, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 0 days.

(21) Appl. No.: 13/931,441

(22) Filed: Jun. 28, 2013

(65) Prior Publication Data

US 2014/0113491 A1 Apr. 24, 2014

(30) Foreign Application Priority Data

Oct. 22, 2012 (TW) ..... 101138975 A

(51) Int. Cl.
*H01R 12/00* (2006.01)
*H01R 12/79* (2011.01)

(52) U.S. Cl.
CPC ..... *H01R 12/79* (2013.01)
USPC ..... 439/67

(58) Field of Classification Search
USPC ..... 439/67, 329, 668, 669, 540.1, 862
See application file for complete search history.

(56) References Cited

U.S. PATENT DOCUMENTS

| | | | | |
|---|---|---|---|---|
| 6,722,894 | B2 * | 4/2004 | Burmeister | 439/67 |
| 7,287,986 | B2 * | 10/2007 | Ho | 439/65 |
| 2003/0232517 | A1 * | 12/2003 | Liu et al. | 439/67 |

* cited by examiner

*Primary Examiner* — Tho D Ta
(74) *Attorney, Agent, or Firm* — Novak, Druce Connolly Bove + Quigg LLP

(57) ABSTRACT

An audio connector includes a receiving portion and a connector. The receiving portion includes a base plate, two opposite sidewalls, and an end wall. The connector includes an insulating body and a plurality of elastic metal fingers. The insulating body is positioned snuggly among the base plate, the two opposite sidewalls, and the end wall.

8 Claims, 5 Drawing Sheets

AUDIO JACK CONNECTOR FOR ELECTRONIC DEVICE

BACKGROUND

1. Technical Field

The present disclosure generally relates to jacks, particularly to an audio jack connector used in an electronic device.

2. Description of Related Art

Electronic devices, such as mobile phones, have an audio jack. The audio jack has a connector, which needs to be electronically connected to a plurality of contacts of a printed circuit board of the electronic device. However, the connector is not easy to align with the contacts on the printed circuit board, so it will effect the electronic connection ability.

Therefore, there is room for improvement within the art.

BRIEF DESCRIPTION OF THE DRAWINGS

Many aspects of an audio jack connector can be better understood with reference to the following drawings. The components in the drawings are not necessarily to scale, the emphasis instead being placed upon clearly illustrating the audio jack connector. Moreover, in the drawings, like reference numerals designate corresponding parts throughout the several views.

DETAILED DESCRIPTION

Figure 1:
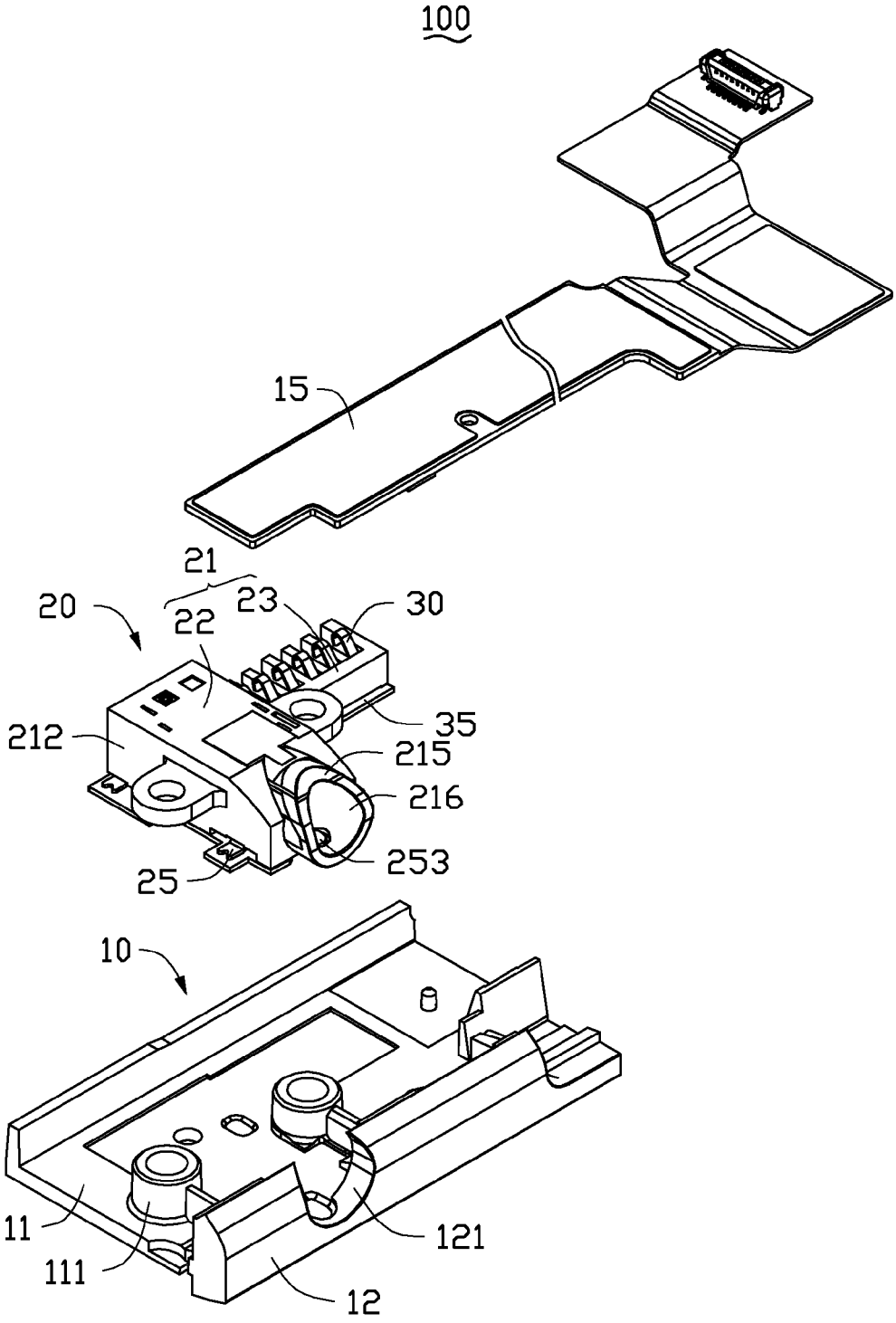
FIG. 1 is an exploded, isometric view of an electronic device with an audio jack connector according to an exemplary embodiment.
Figure 2:
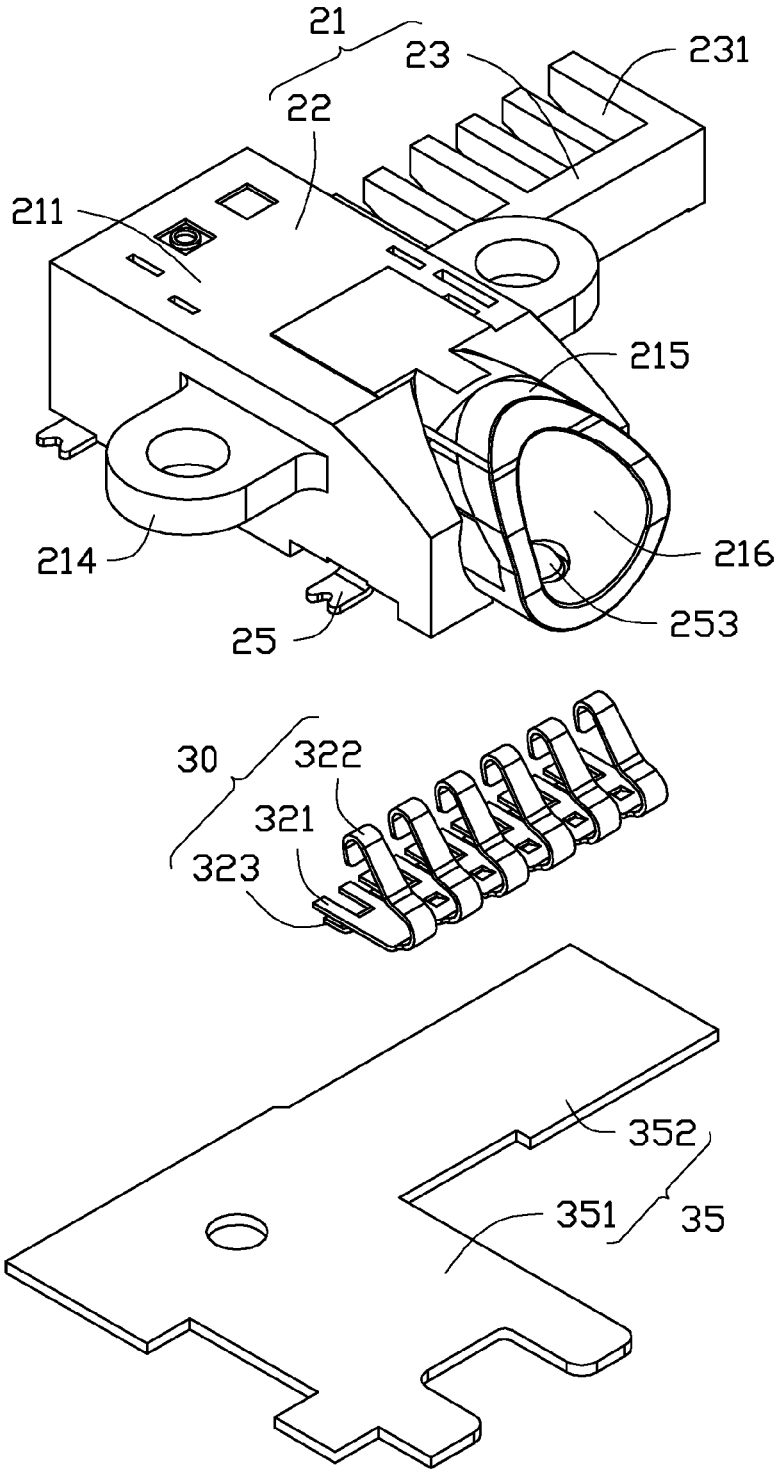
FIG. 2 is an exploded, isometric view of the audio jack connector.

FIG. 1 shows an audio jack connector 20 used in an electronic device 100 according to an exemplary embodiment. The electronic device 100 may be mobile phone. The electronic device 100 comprises a housing 10 and a printed circuit board (PCB) 15.

The housing 10 is positioned at an outside of the electronic device 100. The housing 10 has a main body 11 and a side plate 12 perpendicularly connected to the main body 11. The side plate 12 defines a through hole 121. Two positioning posts 111 are located on the main body 11.

The connector 20 comprises an insulating body 21, a conductive element 25, a plurality of elastic sheets 30 and a flexible printed circuit board (FPCB) 35. The conductive element 25 and the plurality of elastic sheets 30 embedded in the insulating body 21, and are electronically connected to the FPCB 35.

Figure 3:
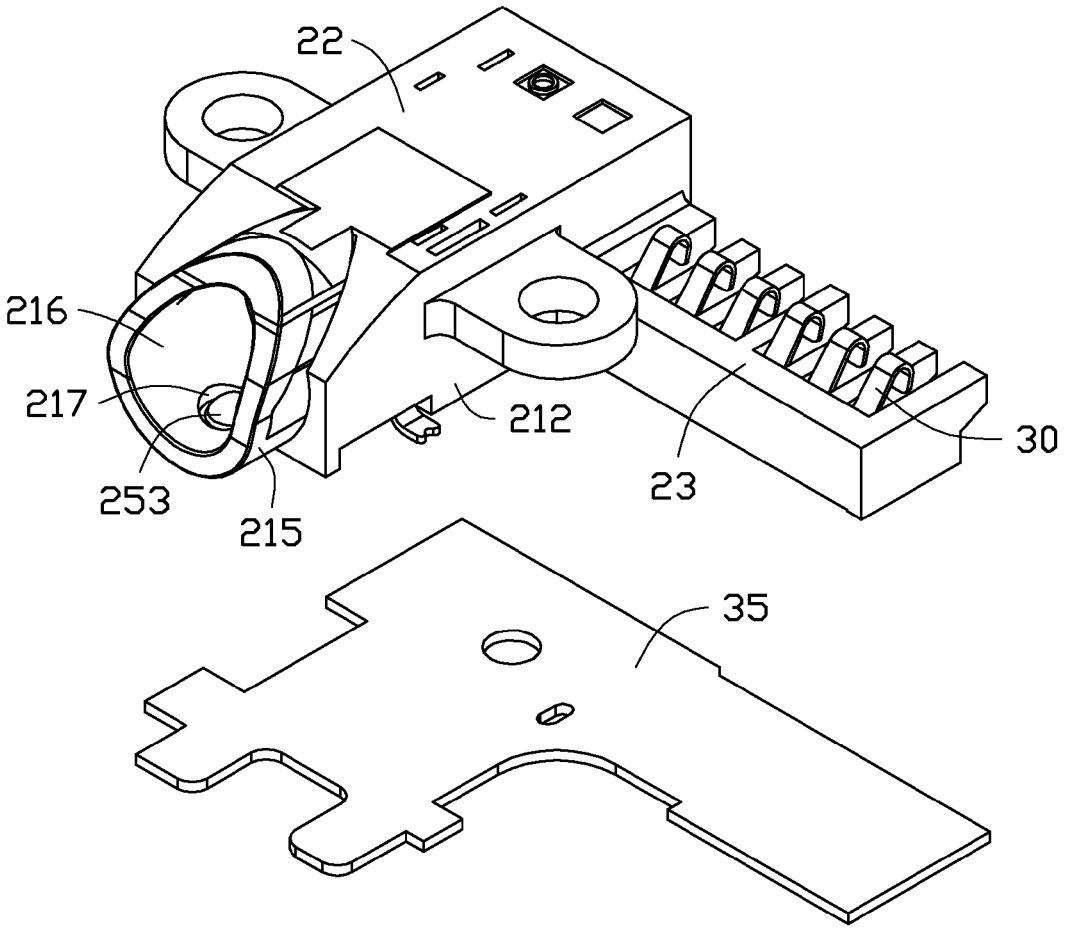
FIGS. 3 and 4 are enlarged views of the audio jack connector from different views.
Figure 4:
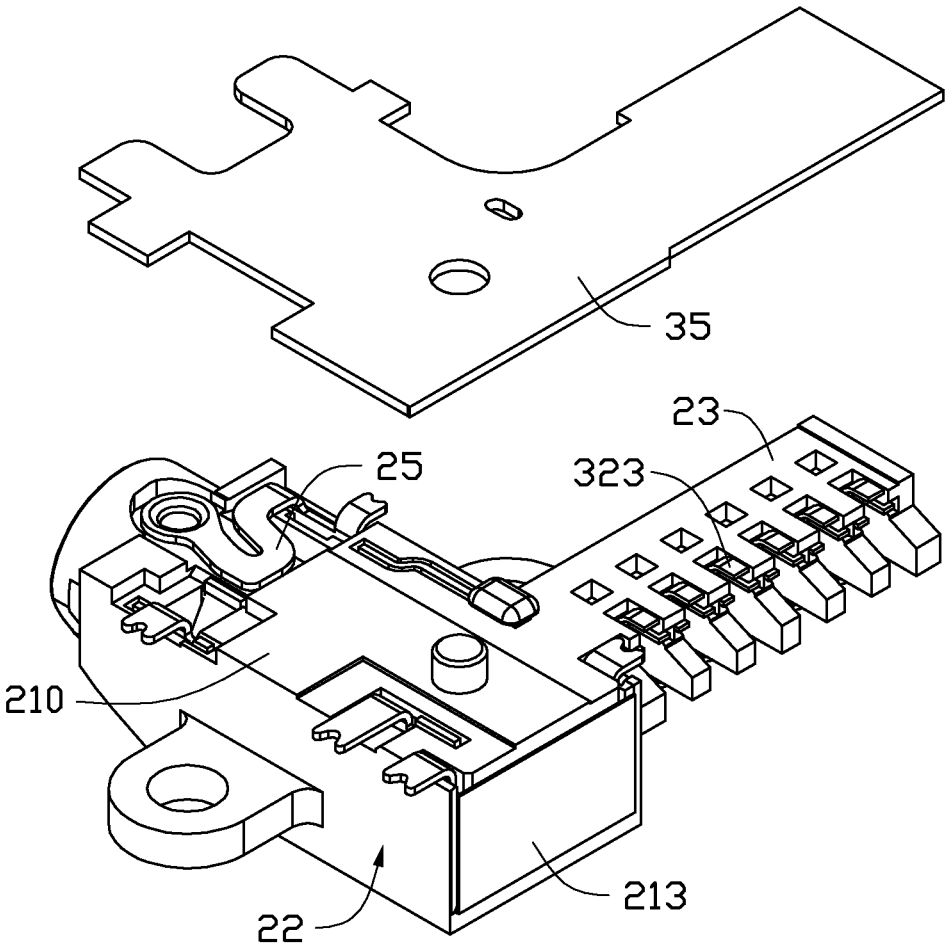

FIGS. 3 and 4 show that the insulating body 21 has a jack portion 22 and a receiving portion 23 being integral together. The jack portion 22 comprises a first surface 210, a second surface 211, two opposite sidewalls 212 and two opposite end walls 213 connected to each other. Each sidewalls has 212 has an extending plate 214 for engaging with the positioning posts 111 of the main body 11. One of the end walls 213 has a cylindrical seat portion 215 for receiving a plug. The seat portion 215 defines a plug hole 216 and a slot 217 communicating with each other. The receiving portion 23 is located at one of the sidewalls 212. The receiving portion 23 defines a plurality of cutouts 231 for receiving the plurality of elastic sheets 30.

The conductive element 25 is secured at one side of the insulation body 21 and has a contact 253 exposed from the slot 217. The elastic sheets 30 are spaced apart and arranged in the cutouts 231 of the insulation body 21. Each elastic sheet 30 comprises a latching portion 321, an arcuate portion 322, and a conductive portion 323 being integral together. The latching portion 321 is latched in the receiving portion 23. The arcuate portion 322 elastically abuts against the PCB 15. The conductive portion 323 is electronically connected to the FPCB 35. The FPCB 35 has a first plate portion 351 and a second plate portion 352. The first plate portion 351 is positioned under the jack portion 22, and the second plate portion 352 is positioned under the receiving portion 23.

Figure 5:
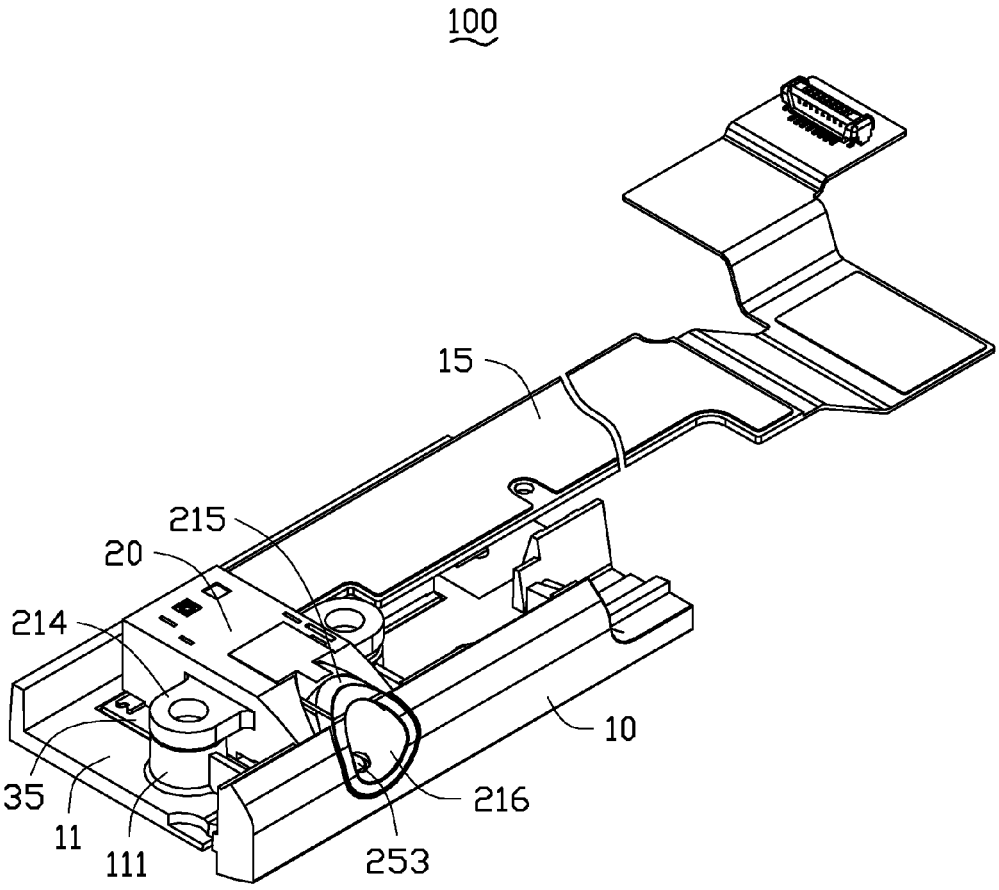
FIG. 5 is an assembled view of the audio jack connector installed in the electronic device.

In assembly, referring to FIG. 5, the conductive element 25 is embedded in the insulation body 21, and allows the contact 253 to be exposed from the slot 217. The elastic sheets 30 are spaced apart and arranged in the cutouts 231 of the insulation body 21. The FPCB 35 is positioned at one side of the connector 20, and the second plate portion 352 electronically abuts against the conductive portions 323. Then, the connector 20 is assembled to the main body 11 of the housing 10, and the seat portion 215 is aligned with the through hole 121 of the side plate 12. The extending plates 214 are engaged with the two positioning posts 111 for securing the connector 20 to the housing 10. Thus, the assembly process of the audio jack connector is completed.

The PCB 15 lays on top of the connector 20, and electronically abut against the elastic sheet 30. Thus, the conductive element 25 is electronically connected to the PCB 15 via the FPCB 35.

It is to be understood, however, that even through numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An audio connector comprising:

an insulating body comprising a jack portion and a receiving portion being integral together;

a conductive element secured in the jack portion;

a plurality of elastic sheets secured in the receiving portion; and a flexible printed circuit board positioned at one side of the conductive element and electronically connected to the conductive element, wherein one end of the plurality of elastic sheets are electronically connected to the flexible printed circuit board, and another end of the plurality of elastic sheets are electronically connected to a printed circuit board, and wherein the flexible printed circuit board has a first plate portion and a second plate portion, the first plate portion is positioned under the jack portion, and the second plate portion is positioned under the receiving portion.

2. The audio connector as claimed in claim 1, wherein the jack portion has a seat portion, the seat portion defines a plug hole and a slot communicating with each other, and the conductive element has a contact exposed from the slot in the plug hole.

3. The audio connector as claimed in claim 2, wherein the receiving portion is located at one side of the jack portion, and the receiving portion defines a plurality of cutouts for receiving the plurality of elastic sheets.

4. The audio connector as claimed in claim 3, wherein each elastic sheet comprises a latching portion, an arcuate portion, and a conductive portion being integral together; and the latching portion is latched in the receiving portion, and the conductive portion is electronically connected to the flexible printed circuit board.

5. An electronic device, comprising:

a housing;

a printed circuit board; and an audio connector assembled to the housing, the audio connector comprising:

an insulating body comprising a jack portion and a receiving portion;

a conductive element secured in the jack portion;

a plurality of elastic sheets secured in the receiving portion; and a flexible printed circuit board positioned at one side of the conductive element and electronically connected to the conductive element, wherein one end of the plurality of elastic sheets are electronically connected to the flexible printed circuit board, and another end of the plurality of elastic sheets are electronically connected to the printed circuit board, and wherein the flexible printed circuit board has a first plate portion and a second plate portion, the first plate portion is positioned under the jack portion, and the second plate portion is positioned under the receiving portion.

6. The electronic device as claimed in claim 5, wherein the jack portion has a seat portion, the seat portion defines a plug hole and a slot communicating with each other, the conductive element has a contact exposed from the slot in the plug hole.

7. The electronic device as claimed in claim 6, wherein the receiving portion is located at one side of the jack portion, the receiving portion defines a plurality of cutouts for receiving the plurality of elastic sheets.

8. The electronic device as claimed in claim 7, wherein each elastic sheet comprises a latching portion, an arcuate portion, and a conductive portion being integral together; and the latching portion is latched in the receiving portion, and the conductive portion is electronically connected to the flexible printed circuit board.

* * * * *